US007491103B1

(12) United States Patent
Clifford et al.

(10) Patent No.: US 7,491,103 B1
(45) Date of Patent: Feb. 17, 2009

(54) MARINE PROPULSION DEVICE WITH ACCESS OPENING

(75) Inventors: Robert W. Clifford, Stillwater, OK (US); Keith W. Schmidt, Stillwater, OK (US); Rodney M. Caldwell, Pawnee, OK (US)

(73) Assignee: Brunswick Corporation, Lake Forest, IL (US)

( * ) Notice: Subject to any disclaimer, the term of this patent is extended or adjusted under 35 U.S.C. 154(b) by 2 days.

(21) Appl. No.: 11/784,689

(22) Filed: Apr. 9, 2007

(51) Int. Cl.
*B63H 5/125* (2006.01)

(52) U.S. Cl. ..... 440/57

(58) Field of Classification Search ..... 440/57
See application file for complete search history.

(56) References Cited

U.S. PATENT DOCUMENTS 4,289,488 A * 9/1981 Weronke et al. ..... 440/57
4,565,532 A 1/1986 Connor ..... 440/57
4,645,464 A 2/1987 Rawlings ..... 440/57
4,654,013 A * 3/1987 Bland et al. ..... 440/57
4,659,315 A 4/1987 Bland et al. ..... 440/61
6,322,404 B1 11/2001 Magee et al. ..... 440/2
6,371,820 B1 4/2002 Neisen et al. ..... 440/57
7,175,491 B1 2/2007 Davis et al. ..... 440/111

* cited by examiner

*Primary Examiner*—Stephen Avila
(74) *Attorney, Agent, or Firm*—William D. Lanyi

(57) ABSTRACT

A marine propulsion device is provided with an access opening through a portion of its gimbal housing. At least two support locations, formed integrally with the gimbal housing, provide locations to support a swivel shaft that attaches a gimbal ring to the gimbal housing. A steering lever is attached to the swivel shaft at a location between the points of support. The shaft extends through cylindrical holes in both support portions of the gimbal housing and a nut extends at least partially through one of the cylindrical holes to retain the swivel shaft and steering lever in position. The nut is removable from the shaft by accessing the nut through the opening formed in the support structure of the gimbal housing.

8 Claims, 6 Drawing Sheets

MARINE PROPULSION DEVICE WITH ACCESS OPENING

BACKGROUND OF THE INVENTION

1. Field of the Invention

The present invention is generally related to a marine propulsion device and, more particularly, to a sterndrive unit that has an access opening which facilitates the disassembly and removal of a nut from the swivel shaft which connects a gimbal ring to a gimbal housing, or support structure.

2. Description of the Related Art

Those skilled in the art of marine propulsion devices and, more specifically, sterndrive units, are familiar with the structure of those devices and the manner in which a bell housing is supported by a gimbal ring and the gimbal ring is supported by a gimbal housing. In addition, those skilled in the art of marine propulsion devices are familiar with the manner in which a drive unit of a sterndrive system is pivotally supported for rotation about a steering axis and a tilt or trim axis.

U.S. Pat. No. 4,289,488, which issued to Weronke et al. on Sep. 15, 1981, discloses a sterndrive gimbal arrangement. It uses a gimbal ring to support the external propulsion unit. The gimbal ring is provided with an upper vertical square bore, a slot across the bore, and clamping bolts to provide full engagement with the square sides of a steering swivel shaft.

U.S. Pat. No. 4,565,532, which issued to Connor on Jan. 21, 1986, describes a sterndrive. A drive mechanism for a boat having the motor located inboard is disclosed. The mechanism includes a gear box located outboard of the transom with an input shaft extending toward the inboard motor and an outboard shaft extending aft toward a propeller shaft. A universal joint coupling is provided to drive the propeller shaft while a gimbal ring is employed to universally mount a propeller shaft housing such that the propeller may be used for steerage as well as forward thrust.

U.S. Pat. No. 4,645,464, which issued to Rawlings on Feb. 24, 1987, describes a steering and tilting means for a marine propulsion device. The device comprises a gimbal housing adapted to be fixedly mounted on a boat transom, a gimbal ring pivotally mounted on the gimbal housing for pivotal movement relative to the gimbal housing about a generally vertical axis, the gimbal ring including a lower end, and a support arm extending rearwardly from the lower end. A generally horizontal cross member extends across the lower end for preventing deflection of the support arm. A propulsion unit extends rearwardly of the gimbal ring and is pivotally connected to the gimbal ring for pivotal movement relative to the gimbal ring about a generally horizontal tilt axis.

U.S. Pat. No. 4,654,013, which issued to Bland et al. on Mar. 31, 1987, describes a steering means for a marine propulsion device. The device comprises a gimbal housing adapted to be fixedly attached to the rear of a boat transom, a gimbal ring, and a structure accessible from rearward of the boat transom for removably connecting the gimbal ring to the gimbal housing so as to provide for pivotal movement of the gimbal ring relative to the gimbal housing about a generally vertical steering axis.

U.S. Pat. No. 4,659,315, which issued to Bland et al. on Apr. 21, 1987, describes a hydraulic system for marine propulsion devices. The device comprises a gimbal housing adapted to be fixedly attached to the transom of a boat and including an end plate adapted to be generally aligned with the boat transom and having an opening, opposite sides, and a rear surface, the gimbal housing also including a first generally vertical side member extending rearwardly from one side of the end plate and a second generally vertical side member extending rearwardly from the other side of the end plate. A gimbal ring is pivotally connected to the gimbal housing for pivotal movement relative to the gimbal housing about a generally vertical steering axis.

U.S. Pat. No. 6,322,404, which issued to Magee et al. on Nov. 27, 2001, discloses a hall effect trim sensor system for a marine vessel. The sensor is mounted on a pivotal member of a marine propulsion system and a rotatable portion of the rotational position sensor is attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

U.S. Pat. No. 6,371,820, which issued to Neisen et al. on Apr. 16, 2002, describes an integral piece gimbal ring and steering assembly for marine propulsion systems. The system has an integral piece gimbal ring and steering means. The system is made up of a gimbal housing affixed through the rear of a boat transom and a gimbal ring pivotally connected to the gimbal housing. The system is further made up of a steering assembly configured to provide pivotal movement of the gimbal ring relative to the gimbal housing about a steering axis. The gimbal ring and the steering assembly comprise an integral piece assembly.

U.S. Pat. No. 7,175,491, which issued to Davis et al. on Feb. 13, 2007, discloses an assembly system for a marine propulsion device. A marine propulsion system is configured to be assembled, as one unitary structure, into a marine vessel. A transom attachment member is provided and is attachable to both an engine and a drive unit to form a single marine propulsion system structure which can be lowered into an opening formed in a transom of a marine vessel.

The patents described above are hereby expressly incorporated by reference in the description of the present invention.

It would be significantly advantageous if a sterndrive device could be provided with an access opening to facilitate the disassembly of the gimbal ring from the gimbal housing while also providing support locations for the swivel shaft that are plural in number, spaced apart, and configured to support the shaft on two sides of a steering lever.

SUMMARY OF THE INVENTION

A marine propulsion device, made in accordance with a preferred embodiment of the present invention, comprises a support structure which is attachable to a transom of a marine vessel, a gimbal ring rotatably supported by the support structure, a shaft rotatably supported by the support structure and attached to the gimbal ring, a steering lever connected to the shaft, a nut attached to a threaded portion of the shaft, an access opening formed in the support structure, and a cover which is removably attached to the support structure and disposable over the access opening. The shaft, in a preferred embodiment of the present invention, is rotatable about a steering axis. The nut and the steering lever are configured to rigidly attach the steering lever to the shaft. The steering lever is rotatable about the steering axis. The steering axis extends through the access opening.

In a particularly preferred embodiment of the present invention, a first cylindrical hole is formed through a first portion of the support structure and a second cylindrical hole is formed through a second portion of the support structure. The first and second cylindrical holes are coaxial with each other and with the steering axis. The shaft extends at least partially through the first and second cylindrical holes. The steering lever is retained between the nut and the support structure. The support structure, in a preferred embodiment of the present invention, is a gimbal housing. The nut extends at least partially through the first cylindrical hole. The steering arm is disposed between the first and second cylindrical holes.

In a preferred embodiment of the present invention, the nut is removable from the shaft along a path which is parallel to the steering axis. The path extends through the access opening. The steering axis is generally vertical in a preferred embodiment of the present invention when the support structure is attached to the transom of the marine vessel. In a particularly preferred embodiment of the present invention, the nut is removable from the shaft in a direction away from the shaft, through at least a portion of the first cylindrical hole, along a path which is parallel to the steering axis, and through the access opening. The shaft is removable from the nut in a direction toward a center of the gimbal ring.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
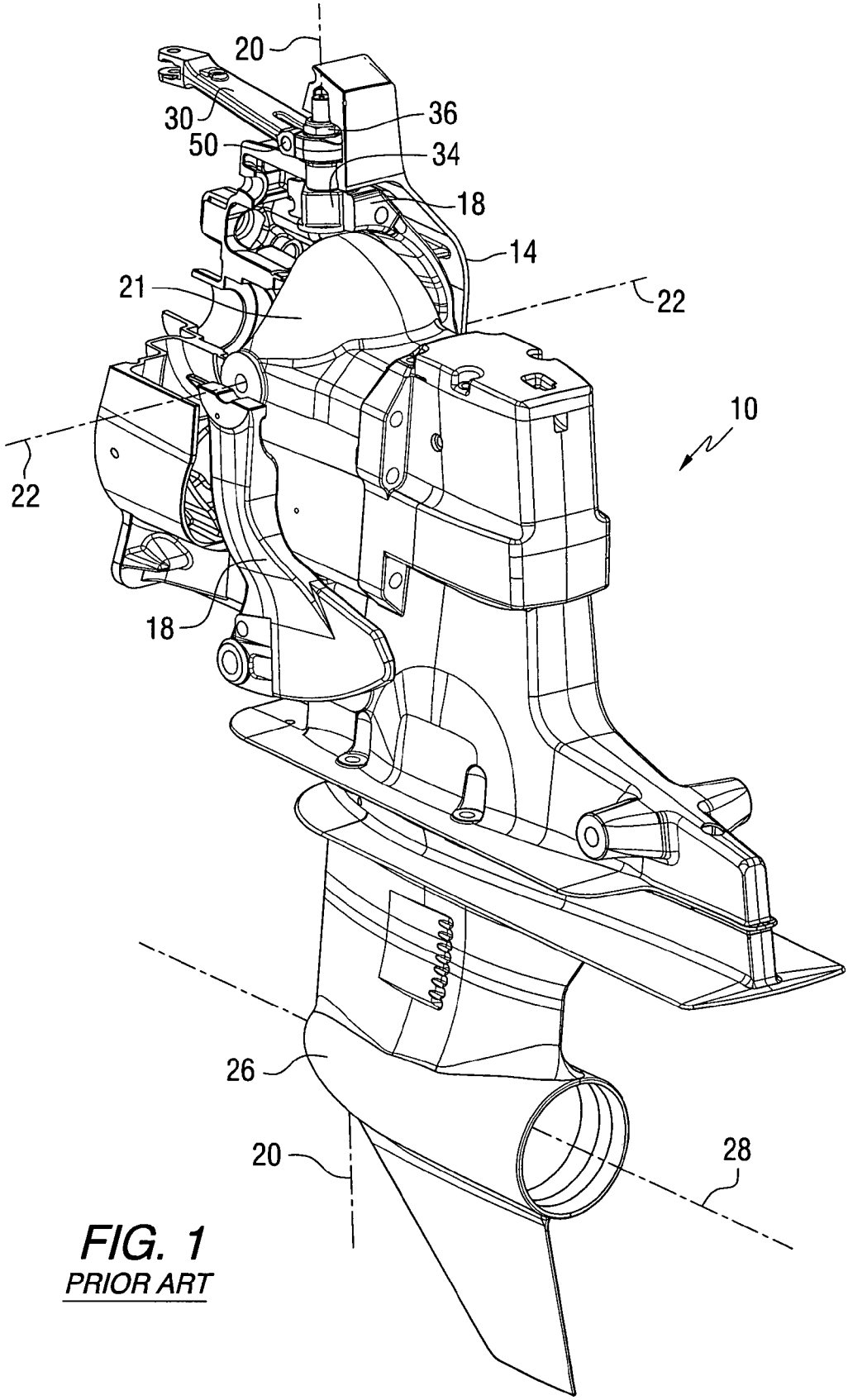
FIG. 1 PRIOR ART
FIG. 1 is an isometric view of a marine drive known to those skilled in the art.

Throughout the description of the preferred embodiment of the present invention, like components will be identified by like reference numerals.

FIG. 1 illustrates a sterndrive device 10. The illustration is partially sectioned to expose certain relevant components that will be used to describe the prior art so that the present invention, described in detail below, will be more easily understood. The sterndrive device 10 comprises a gimbal housing 14 which supports a gimbal ring 18 for rotation about a steering axis 20. The gimbal ring 18 supports a bell housing 21 for rotation about a generally horizontal tilt axis 22. A gear case 26 supports a propeller shaft (not shown in FIG. 1) for rotation about a propeller axis 28. In a manner that is well known to those skilled in the art, a propeller is attached to the propeller shaft and rotated to provide propulsive thrust for a marine vessel.

With continued reference to FIG. 1, the sterndrive unit 10 is provided with a steering lever 30 which is attached to a shaft 34 by a nut 36. The shaft attaches the steering lever 30 to the gimbal ring 18. The steering lever 30, the shaft 34, the gimbal ring 18, and the nut 36 are all connected together and are rotatable about the steering axis 20.

Figure 2:
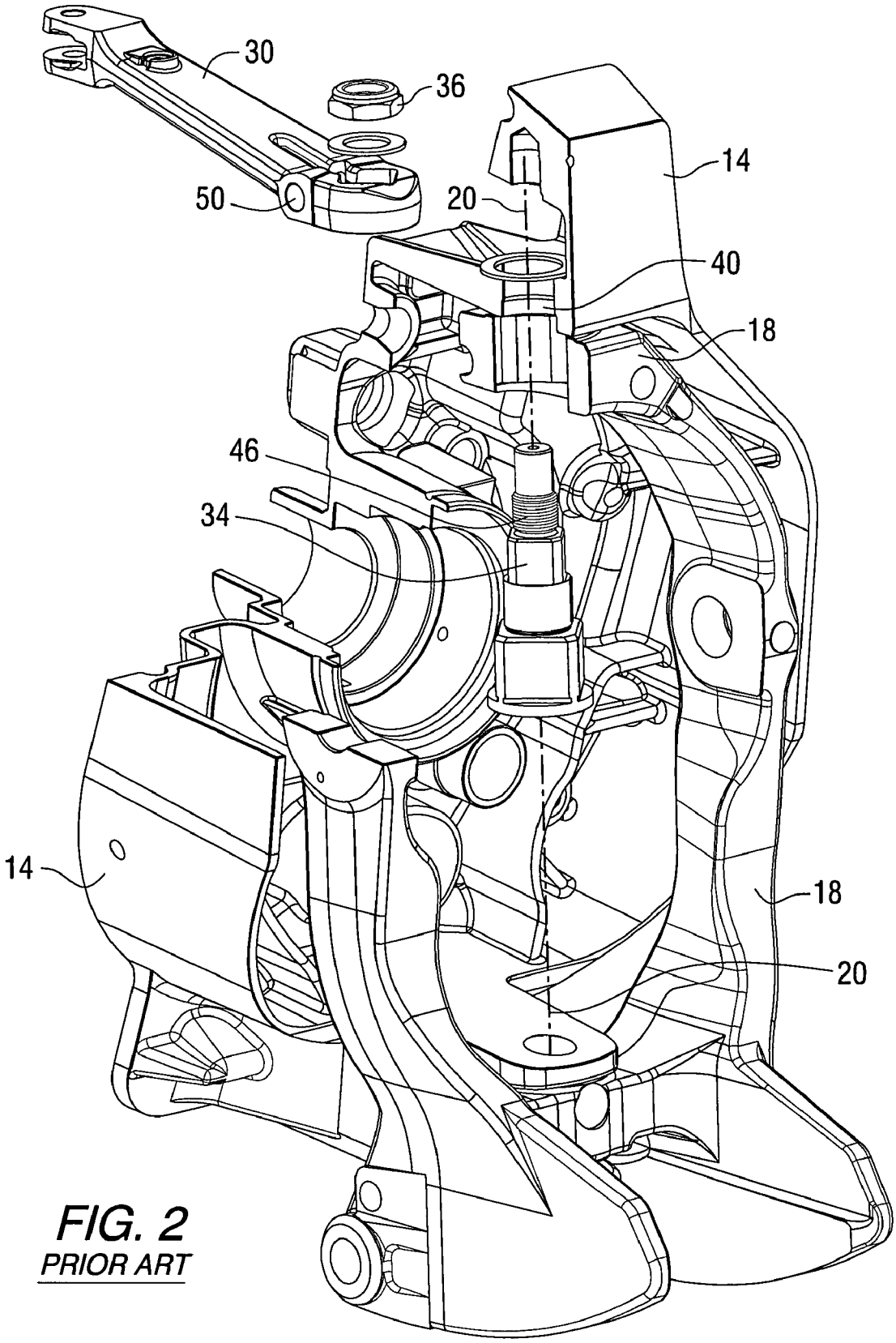
FIG. 2 PRIOR ART
FIG. 2 is an exploded isometric view of a portion of the drive shown in FIG. 1.

FIG. 2 is an exploded isometric view of the sterndrive device 10 shown in FIG. 1, but with the bell housing 21 and drive unit removed to facilitate the explanation of the components shown in FIG. 2. The illustration in FIG. 2 is partially sectioned to expose various components that are relevant to the explanation of the present invention which will be described in greater detail below.

The shaft 34 extends through the gimbal ring 18 and through an opening 40 which is formed in the gimbal housing 14. The upper end of the shaft 34 is provided with threads which are configured to receive the nut 36 in threaded association thereon. The steering lever 30 is attached to the shaft 34 and to the gimbal ring 18 when the nut 36 is tightened onto the threaded portion 46 of the shaft 34.

With continued reference to FIGS. 1 and 2, it can be seen that the removal of the shaft 34 requires a loosening of the nut 36. In order to remove the steering lever 30 from the gimbal housing 14, the bell housing 21 must first be removed from the gimbal ring 18 and then the nut 36 must be loosened from the shaft 34 to allow the shaft 34 to be removed in a downward direction parallel to the steering axis 20. Then, the nut 36 can be removed along with the steering lever 30. A device such as that shown in FIGS. 1 and 2 requires access to the nut 36 from a position within the marine vessel. In addition, a pinch bolt (not visible in FIGS. 1 and 2), is located at the position identified by reference numeral 50 and must be accessed and loosened in order to allow the shaft 34 to drop downwardly relative to the steering lever 30. The access to the nut 36 and the pinch bolt 50, from a position within the marine vessel forward from the steering axis 20 does not provide for an easy removal and disassembly process.

Figure 3:
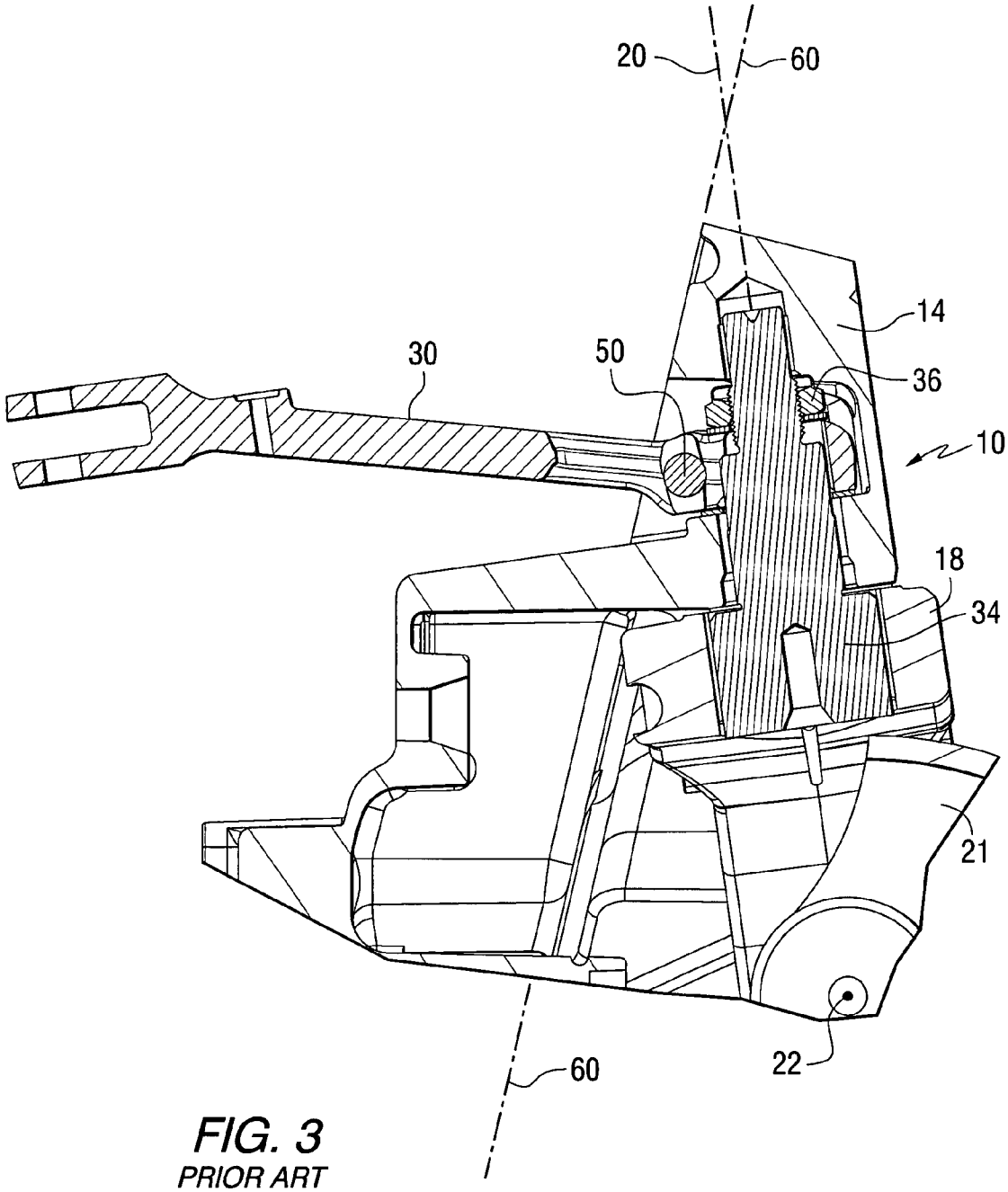
FIG. 3 PRIOR ART
FIG. 3 is a side sectional view of a portion of the drive shown in FIGS. 1 and 2.

FIG. 3 is an enlarged sectional view of the upper portion of the drive unit 10 described above in conjunction with FIGS. 1 and 2. It is provided to illustrate that the steering lever 30, the pinch bolt 50, and the nut 36 must be accessed from a position forward of the nut 36. Dashed line 60 is provided to show the plane of the rear surface of the transom of a marine vessel to which the drive unit 10 is attached. The nut 36 and pinch bolt 50 must be accessed from a position to the left of that plane 60 or, alternatively stated, from within the marine vessel itself. The process would include the removal of the bell housing 21 and associated drive unit components, the loosening of the nut 36, the loosening of the pinch bolt 50, and the progressive removal of the shaft 34 in a downward direction toward the center of the gimbal ring 18 as the nut 36 is removably rotated relative to the threads of the shaft 30. Eventually, the shaft 34 can be moved downwardly into the central portion of the gimbal ring 18, the nut 36 can be removed toward the left in FIG. 3, and the steering lever 30 can be removed toward the left. The pinch bolt 50 would normally be loosened prior to the rotation of the nut 36 relative to the shaft 34 to allow the shaft 34 to move downwardly through and away from its opening in the gimbal ring 18.

Figure 4:
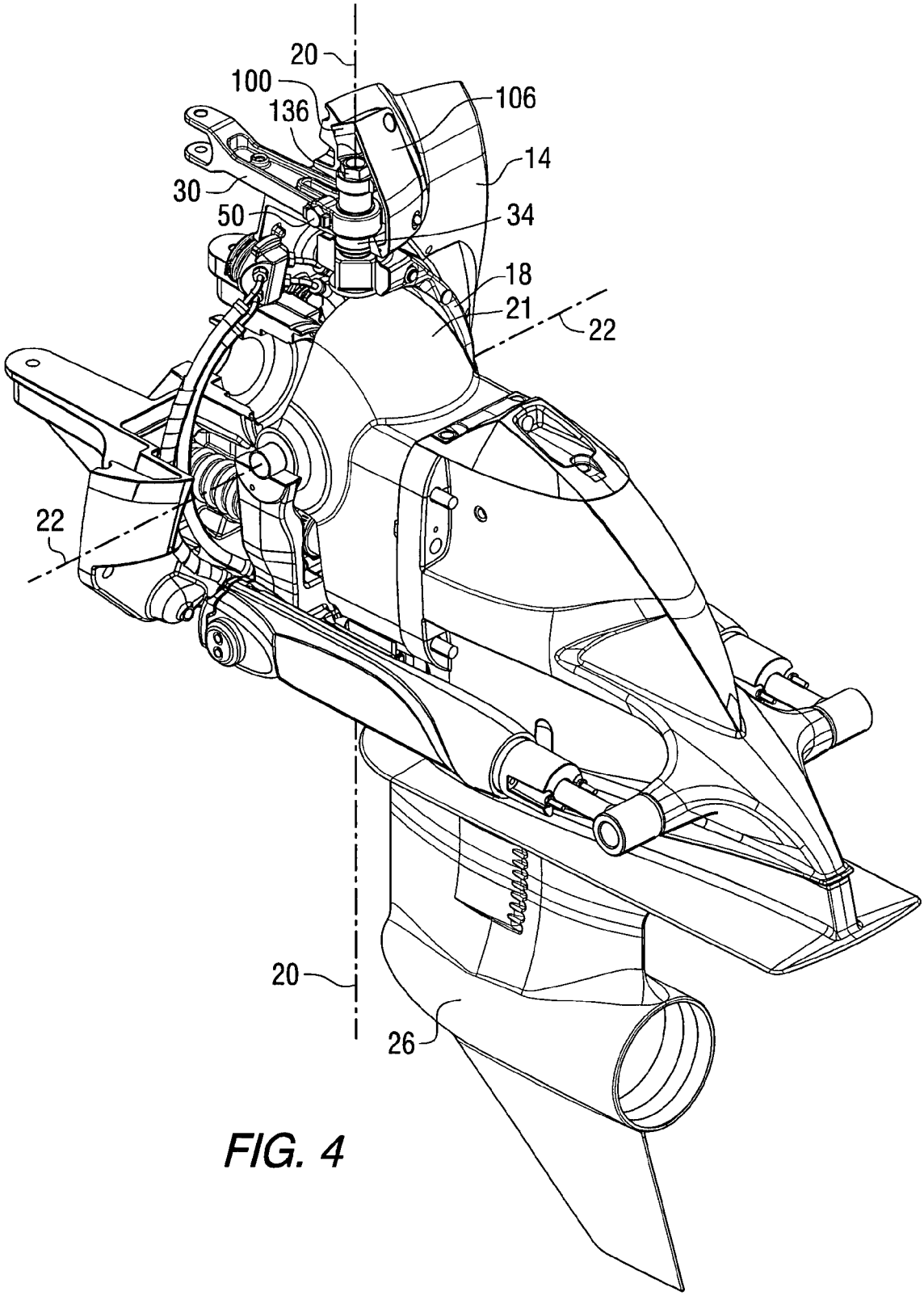
FIG. 4 is an isometric view of a marine drive made in accordance with a preferred embodiment of the present invention.
Figure 5:
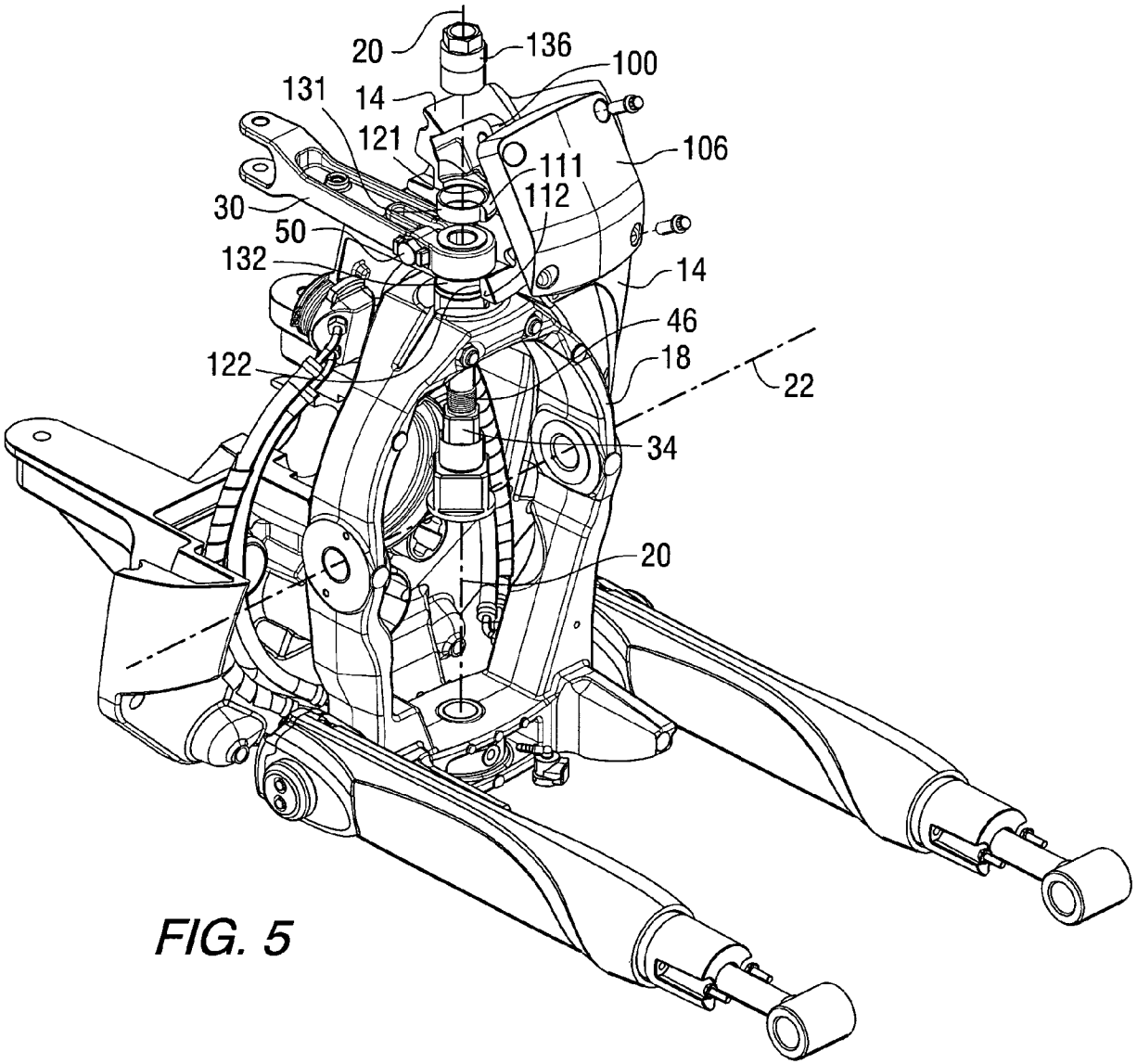
FIG. 5 is an exploded isometric view of a portion of the drive shown in FIG. 4.

FIG. 4 is an isometric, partially sectioned, view of a sterndrive device made in accordance with a preferred embodiment of the present invention. The basic support of the bell housing 21 by the gimbal ring 18 is generally similar to that described above. Also, the basic structure of the shaft which pivotably attaches the gimbal ring 18 to the gimbal housing 14 is generally the same as that described above in conjunction with FIGS. 1-3. However, the gimbal housing 14, or support structure, is provided with an opening 100 and a cover 106 shaped to be attached to the gimbal housing 14 to enclose the opening 100. Removal of the cover 106 allows easy access to a nut 136, from a position behind the transom, that is used to attach the steering lever 30 to the shaft 34 and the gimbal ring 18. As can be seen in FIG. 4, the steering axis 20 extends through the opening 100. FIG. 5 is an exploded isometric view that is generally similar to FIG. 4, but with the various component parts shown separated from each other.

With continued reference to FIGS. 4 and 5, a significant difference between the present invention and known systems is the provision of first and second portions, 111 and 112, that provide support for the shaft 34 and are spaced apart, as shown in FIG. 5, to allow the steering lever 30 to be disposed between them. The first portion 111, or first support platform, is provided with a first cylindrical hole 121 and the second portion 112, or second support platform, is provided with a second cylindrical hole 122. The first cylindrical hole 121 is formed through the first portion 111 of the support structure 14, or gimbal housing. The second cylindrical hole 122 is formed through the second portion 112 of the support structure 14, or gimbal housing. The first and second cylindrical holes, 121 and 122, are coaxial with each other and with the steering axis 20. The shaft 34 extends completely through the second cylindrical hole 122 and at least partially through the first cylindrical hole 121. In FIG. 5, an first bushing 131 is shown disposed in the first cylindrical hole 121 and a second bushing 132 is shown within the second cylindrical hole 122. In a particularly preferred embodiment of the present invention, the nut 136 extends into and partially through the first cylindrical hole 121 and the outer cylindrical surface of the nut 136 is rotatably supported within the first bushing 131. The shaft 34 is therefore supported at two locations, one within the first cylindrical hole 121 and another within the second cylindrical hole 122. Within the structure of the first portion 111, the upper portion of the shaft 34 is disposed within the nut 136 which, in turn, is rotatably supported within the first cylindrical hole 121. The first bushing 131, in that particular embodiment of the present invention, is disposed radially between the outer cylindrical surface of the nut 136 and the inner surface of the first cylindrical hole 121.

With continued reference to FIGS. 4 and 5, it should be noted that the steering axis 20 extends through the opening 100 when the cover 106 is removed from the gimbal housing 14. This provides easy access to the nut 136 which can be rotated relative to the shaft 34 through the use of a socket wrench. As the nut 136 is rotatably loosened from the threaded portion 46 of the shaft 34, it can move upwardly along the steering axis 20 and, eventually, through the opening 100 to be easily removed from the assembly. In addition, the pinch bolt 50 can be accessed through the opening 100 to allow complete removal of the shaft 34 in a downward direction toward the central portion of the gimbal ring 18.

Figure 6:
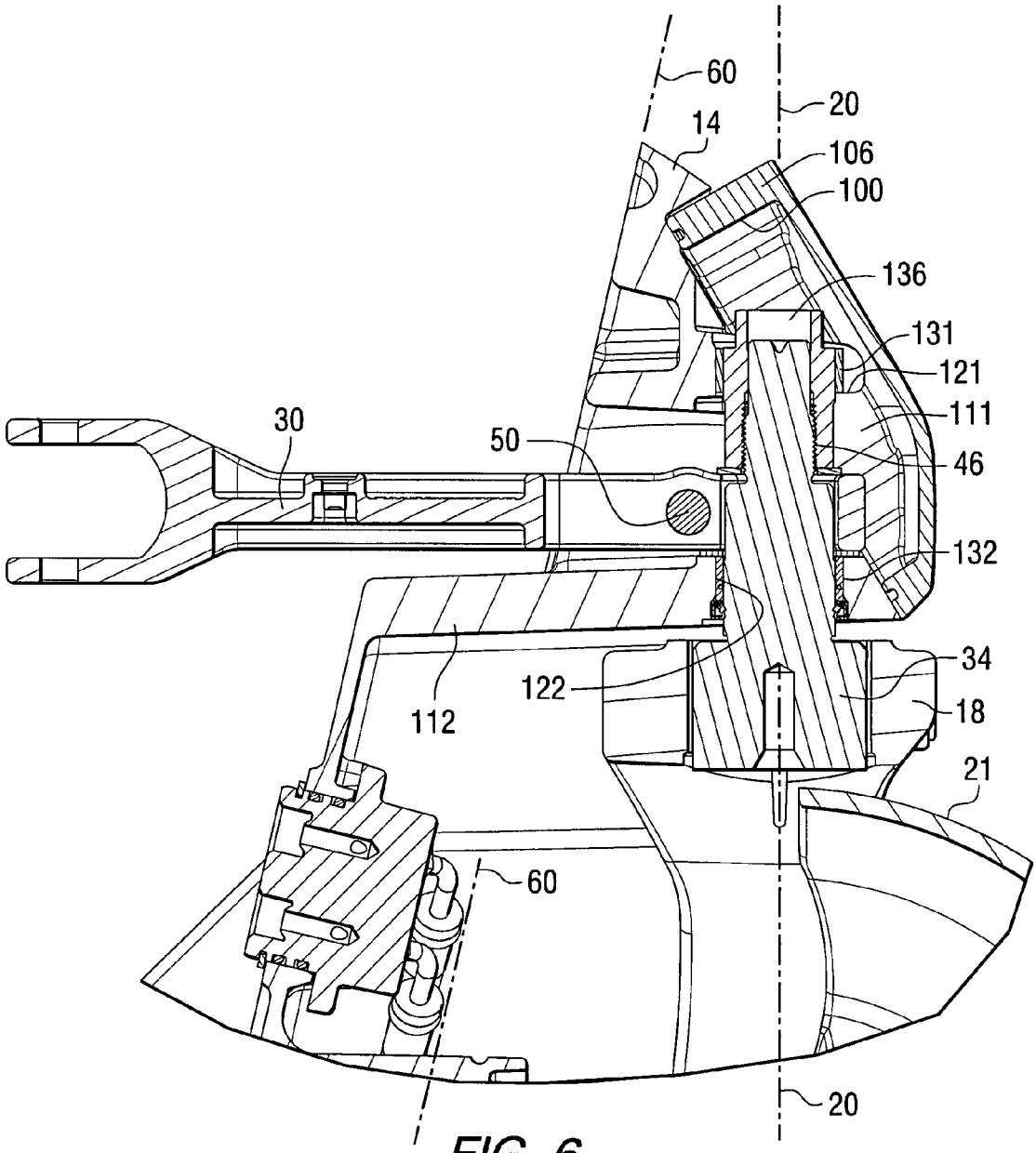
FIG. 6 is an enlarged section view of a portion of the device illustrated in FIGS. 4 and 5.

FIG. 6 is an enlarged section view of the portion of the marine drive that includes shaft 34, the gimbal ring 18, the steering lever 30, the nut 136, the gimbal housing 14, or support structure, the opening 100, and the cover 106. In addition, the first portion 111 is shown with its first cylindrical hole 121 and the second portion 112 is shown with its second cylindrical hole 122. The pinch bolt 50 is also shown in relation to the steering lever 30. The bell housing 21 is attached to the gimbal ring 18. It can be seen that, when the cover 106 is removed from the support structure 14, the opening 100 allows easy access to the nut 136. It can also be seen that rotation of the nut 136 relative to the shaft 34 will allow the nut to move upward along a path that is coincident with the steering axis 20 and pass upwardly through the opening 100 to be removed. Similarly, the pinch bolt 50 is accessible through the opening 100. With the bell housing 21 removed, this allows the shaft 34 to move downwardly in a direction parallel to the steering axis 20.

With continued reference to FIGS. 4-6, it can be seen that the present invention supports the shaft 34 at two locations by having the shaft 34 extend through the first and second cylindrical holes, 121 and 122. The support provided by the first and second portions, 111 and 122, of the support structure 14 provides sufficient support for the shaft 34 and maintains it in alignment with the steering axis 20. These two points of support straddle the steering lever 30.

With continued reference to FIGS. 4-6, it can be seen that a marine propulsion device made in accordance with preferred embodiment of the present invention comprises a support structure 14 that is attachable to a transom of a marine vessel along a plane defined by dashed line 60 in the figures. A gimbal ring 18 is rotatably supported by the support structure 14 and a shaft 34 is rotatably supported by the support structure and attached to the gimbal ring 18. The shaft 34 is rotatable about a steering axis 20. A steering lever 30 is connected to the shaft 34 and the shaft 34 extends through an opening in the steering lever. A first cylindrical hole 121 is formed through a first portion 111 of the support structure 14 and a second cylindrical hole 122 is formed through a second portion 112 of the support structure 14. The first and second cylindrical holes are coaxial with each other and with the steering axis 20. A nut 136 is attached to a threaded portion 46 of the shaft 34. The nut 136 and the steering lever 30 are configured to rigidly attach the steering lever to the shaft. The steering lever 30 is rotatable about the steering axis 20. The shaft 34 extends through the second cylindrical hole 122 and the nut 136 extends at least partially through the first cylindrical hole 121. An access opening 100 is formed in the support structure 14 and the nut 136 is accessible through the access opening 100. A cover 106 is removably attached to the support structure 14 and disposable over the access opening 100. The steering lever 30 is retained between the nut 136 and the second portion 112 of the support structure 14. The steering axis 20 extends through the access opening 100. The steering arm 30 is disposed between the first and second portions, 111 and 112, of the support structure 14. The nut 136 is removable from the shaft 34 in a direction away from the shaft, through at least a portion of the first cylindrical hole 121, along a path which is parallel to the steering axis 20, and through the access opening 100. The steering axis 20 is generally vertical, as illustrated specifically in FIG. 6, when the support structure 14 is attached to the transom of a marine vessel. The shaft 34 is removable from the nut 136 in a direction toward a center of the gimbal ring 18.

Although the present invention has been described with particular specificity and illustrated to show a preferred embodiment, it should be understood that alternative embodiments are also within its scope.

We claim:

1. A marine propulsion device comprising:

a gimbal housing which is attachable to a transom of a marine vessel;

a gimbal ring rotatably supported by said gimbal housing;

a shaft rotatably supported by said gimbal housing and attached to said gimbal ring, said shaft being rotatable about a steering axis;

a steering lever connected to said shaft;

a nut attached to a threaded portion of said shaft, said nut and said steering lever being configured to rigidly attach said steering lever to said shaft, said steering lever being rotatable about said steering axis;

a first cylindrical hole formed through a first portion of said gimbal housing;

a second cylindrical hole formed through a second portion of said gimbal housing, said first and second cylindrical holes being coaxial with each other and with said steering axis;

wherein said nut extends into and at least partially through said first cylindrical hole.

2. The marine propulsion device according to claim 1 wherein said nut has an outer cylindrical surface rotatably supported in said first cylindrical hole.

3. The marine propulsion device according to claim 2 comprising a bushing disposed in said first cylindrical hole, and wherein said outer cylindrical surface of said nut is rotatably supported within said bushing.

4. The marine propulsion device according to claim 3 wherein said first cylindrical hole has an inner surface, and said bushing is disposed radially between said outer cylindrical surface of said nut and said inner surface of said first cylindrical hole.

5. The marine propulsion device according to claim 1 comprising an access opening formed in said gimbal housing, said steering axis extending through said access opening, and a cover which is removably attached to said gimbal housing and disposable over said access opening.

6. The marine propulsion device according to claim 1 wherein said steering lever is retained between said nut and said second portion of said gimbal housing.

7. The marine propulsion device according to claim 6 wherein said steering lever is disposed between said first and second portions of said gimbal housing.

8. The marine propulsion device according to claim 1 wherein said steering lever is retained between said nut and said gimbal housing, and said steering lever is disposed between said first and second cylindrical holes.

* * * * *